United States Patent [19]

Rubin

[11] Patent Number: 4,799,286

[45] Date of Patent: Jan. 24, 1989

[54] POWER DRIVEN VACUUM SWEEPER

[76] Inventor: Berl I. Rubin, 242 Erica St., Philadelphia, Pa. 19116

[21] Appl. No.: 892,591

[22] Filed: Aug. 4, 1986

[51] Int. Cl.[4] ..... A47L 5/34

[52] U.S. Cl. ..... 15/361; 15/355; 51/176; 280/47.26

[58] Field of Search ..... 15/350, 320, 321, 355, 15/353, 340, 368, 361, 363; 280/47.23, 47.24, 47.26; 51/176, 34 R; 384/519, 252, 257, 256, 259, 260

[56] References Cited

U.S. PATENT DOCUMENTS

| | | | |
|---|---|---|---|
| 1,918,519 | 7/1933 | Clements | 51/176 |
| 2,207,225 | 7/1940 | Pennock et al. | 51/176 |
| 2,218,703 | 10/1940 | Emmons | 51/176 |
| 2,277,236 | 3/1942 | Kneisley | 51/176 |
| 2,291,058 | 7/1942 | Pohl | 51/176 |
| 2,488,834 | 11/1949 | Simpson | 51/176 |
| 2,596,689 | 5/1952 | Holt | 51/176 |
| 2,965,293 | 12/1960 | Link | 384/259 |
| 3,063,082 | 11/1962 | Rosenberg | 15/361 |
| 3,636,585 | 1/1972 | Larsen | 15/340 |
| 3,908,223 | 9/1975 | Brooks | 15/361 |
| 4,050,112 | 9/1977 | Saxon | 15/300 |
| 4,162,149 | 7/1979 | Mekelburg | 15/353 |
| 4,355,436 | 10/1982 | Hertzberg | 15/368 |

*Primary Examiner*—Philip R. Coe
*Assistant Examiner*—Corinne M. Reinckens
*Attorney, Agent, or Firm*—John Shaw Stevenson

[57] ABSTRACT

A power driven vacuum sweeper for thoroughly and rapidly removing padding and glued particles which remain attached to a floor after a worn-out carpet has been removed therefrom. The sweeper is characterized by having a cylindrical metal broom mounted on the front end of a frame and arranged for clockwise rotation to bite into and remove the padding and glued particles from the top surface of the floor as a pair of handlebars attached by a lever to the frame of the sweeper is moved forward and in and upward direction about a pair of wheels. The sweeper is further characterized in that the pair of wheels are mounted for a rocking side-wise movement about the frame when either wheel engages irregular high or low floor surfaces thereby allowing the thorough horizontal cleaning position of the entire width of the broom to be maintained under these adverse operating conditions.

7 Claims, 4 Drawing Sheets

POWER DRIVEN VACUUM SWEEPER

BACKGROUND OF THE INVENTION

Applicant's invention relates to a unique power driven vacuum sweeper for thoroughly and rapidly removing padding and glued particles which remain glued to a floor surface prior to the installation of a new carpet.

Prior devices that have been used have attempted to accomplish this feat by employing various types of power driven oscillating scraping tools that are of a chisel shaped construction. Oscillating chisel shaped scraping tools of this type have several shortcomings. First of all, these devices have a tendency to remove not only the padding and glued particles but also a part of the upper wood, concrete or tile surface of the floor to which these glued particles are attached. A second disadvantage is that this way of cleaning a floor before laying down a new carpet is an extremely slow, time-consuming process. Third, the operation of this device is a very tedious one because the operator must periodically examine areas of the floor that have been scraped to see that all of the padded and glued particles have been removed before proceeding with the cleaning of the other areas. Finally, the use of such a scraping device for cleaning a floor requires an additional laborer besides the operator of the scraper to clean up the scrap which remains on the floor after such a scraping operation. The power driven vacuum sweeper covered by this invention eliminates all of these problems and enables a single operator to remove padding and glued particles that are stuck to a floor without any damage to the floor and with only one rapid sweep of the sweeper.

SUMMARY OF THE INVENTION

The subject invention can be used as a power driven vacuum sweeper to rapidly and thoroughly remove in one sweep the carpet padding and dried glue that remains attached to a floor after worn-out carpet has been removed therefrom. The present invention is particularly useful, but no solely useful, in commercial buildings such as department stores where rug replacement on wood, concrete or tile floors occurs frequently. After each long strip of worn rug is removed, it is necessary to provide a completely clean floor surface before a new rug and its padding is glued thereto. The present sweeper removes the padding and glued particles that remain attached to the floor in a thorough, very rapid, economical manner. The present invention employs a sweeper having a cylindrical broom mounted at one end of a frame and handlebars attached by means of a lever to its other end. A pair of aligned wheels on a shaft is uniquely positioned on the lower rear end of the frame and between the broom and handlebars to provide a fulcrum about which an operator can apply in a seesaw manner, a desired pressure of the broom to the floor. More pressure of the bristles of the broom to the floor is obtained by applying hand pressure to the handlebars in an upward direction and less pressure is applied to the broom bristles by applying hand pressure to the handlebars in a downward direction. Furthermore, this construction is arranged so that substantially all of the weight of the frame is supported in an on floor position by the wire bristles of the broom. The broom is power driven by an electric motor and a belt and pulley drive to rotate it in a clockwise direction or a direction that tends to move the sweeper in a rearward direction.

Still another feature of the invention is, therefore, that, as the sweeper handlebars are pushed forward and the wheels are thereby rolled in a forward direction, the aforementioned clockwise movement of the bristles of the broom will provide a desired shearing of the carpet padding and dried glue and thereby cause this sheared material to be turned into a power that can be readily removed by the vacuum system disclosed herein.

An adjustable mechanical means is provided on the lever to increase or decrease the distance between the handlebars and the wheels. This allows the operator of the sweeper to adjustably fix the handlebars in a comfortable grasping position to suit his height. The greater the distance between the handlebars and the wheels, the greater will be the mechanical advantage gained in tilting the broom in a seesaw fashion about the fulcrum formed by the wheels of the sweeper. Hence, less force will need to be applied in an upward or downward direction to the handlebars to pivot the bristles of the brush into or out of biting and shearing engagement with the padding and dried glue. The present invention in this mechanically efficient manner thus enables an operator to use the sweeper to clean large areas of a floor in the aforementioned manner with a minimum amount of labor.

Another feature of the invention is that a baffle plate is provided adjacent to the external surface of the broom which forms a venture with the front inner wall of the frame of the sweeper. This arrangement produces a high velocity flow of air that will allow the aforementioned powder to be sucked up in a rapid manner into a readily removable canister of a vacuum tank that is positioned on top of the frame.

Still another feature of the present invention is that the frame of the sweeper is supported in an off floor position by the broom and the height of the bottom of the frame from said floor is adjustable to one of several selectively fixed spaced-apart relationships. This arrangement allows a desired amount of air to be sucked through the bottom of the sweeper along with the powder and also allows the bristles to be continuously cleaned as they are rotated into bent contact with the floor.

DETAILED DESCRIPTION OF THE DRAWINGS

Figure 1:
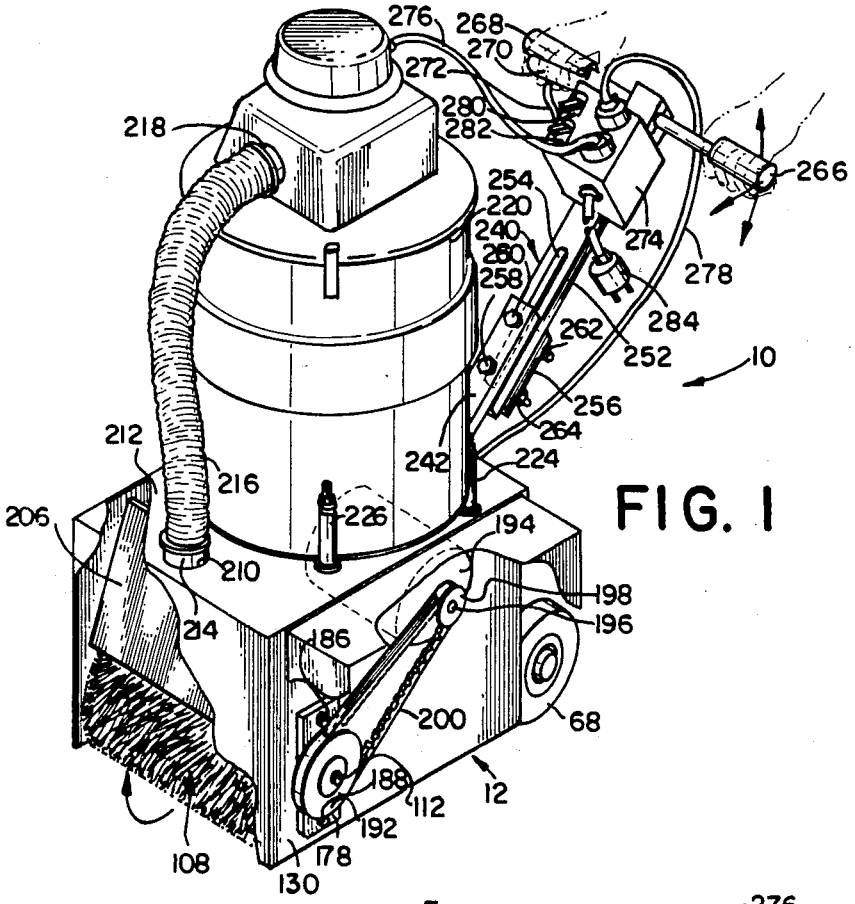
FIG. 1 is a perspective view of the power driven vacuum sweeper.
Figure 2:
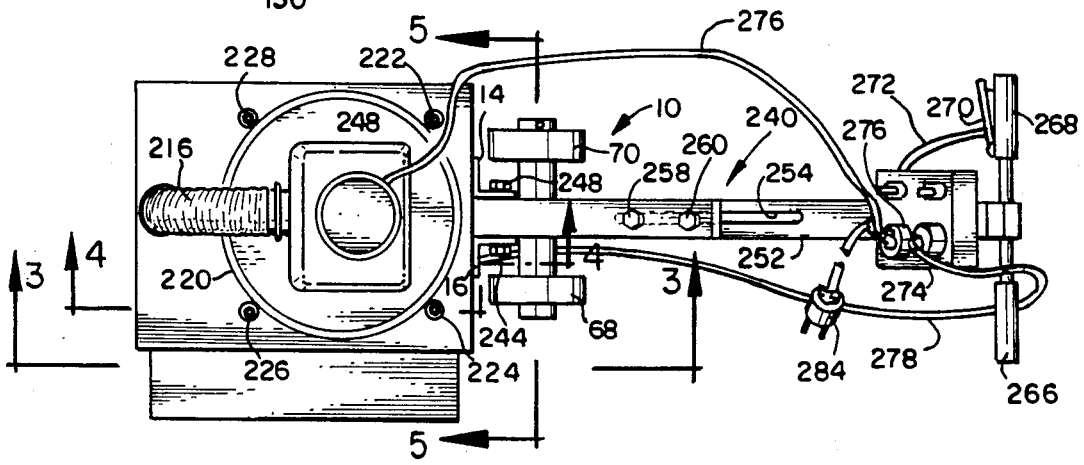
FIG. 2 is a plan view of the sweeper shown in FIG. 1.
Figure 5:
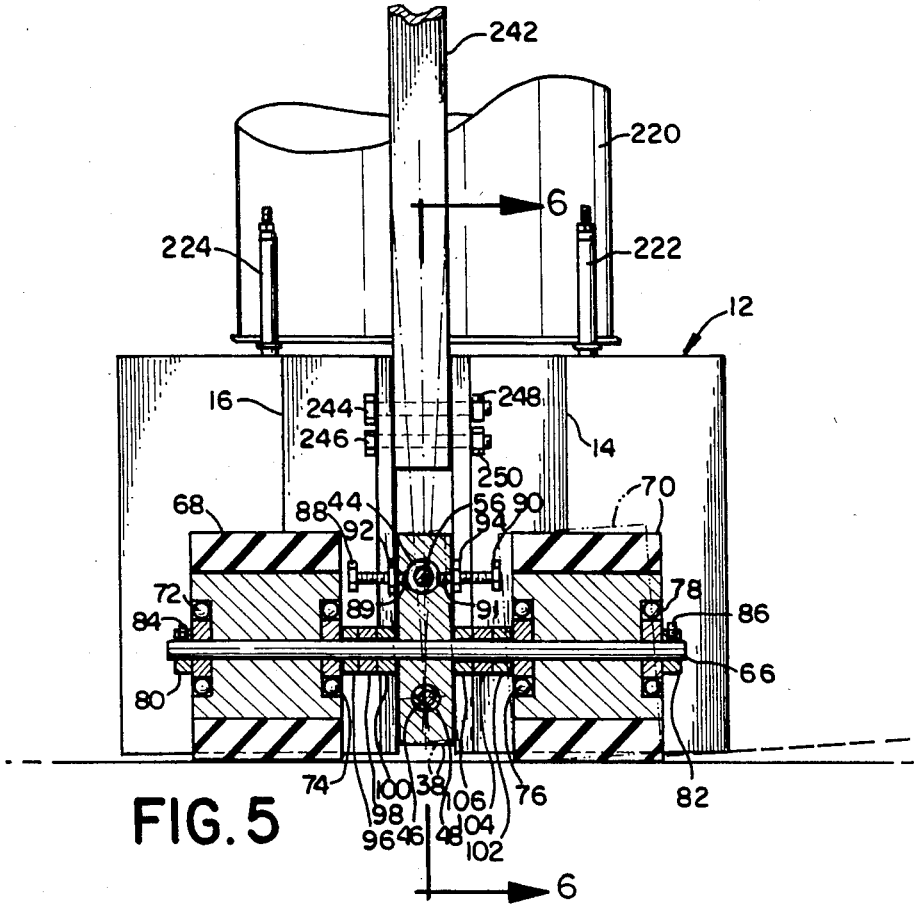
FIG. 5 is a sectional view taken along the line 5—5 of FIG. 2.
Figure 6:
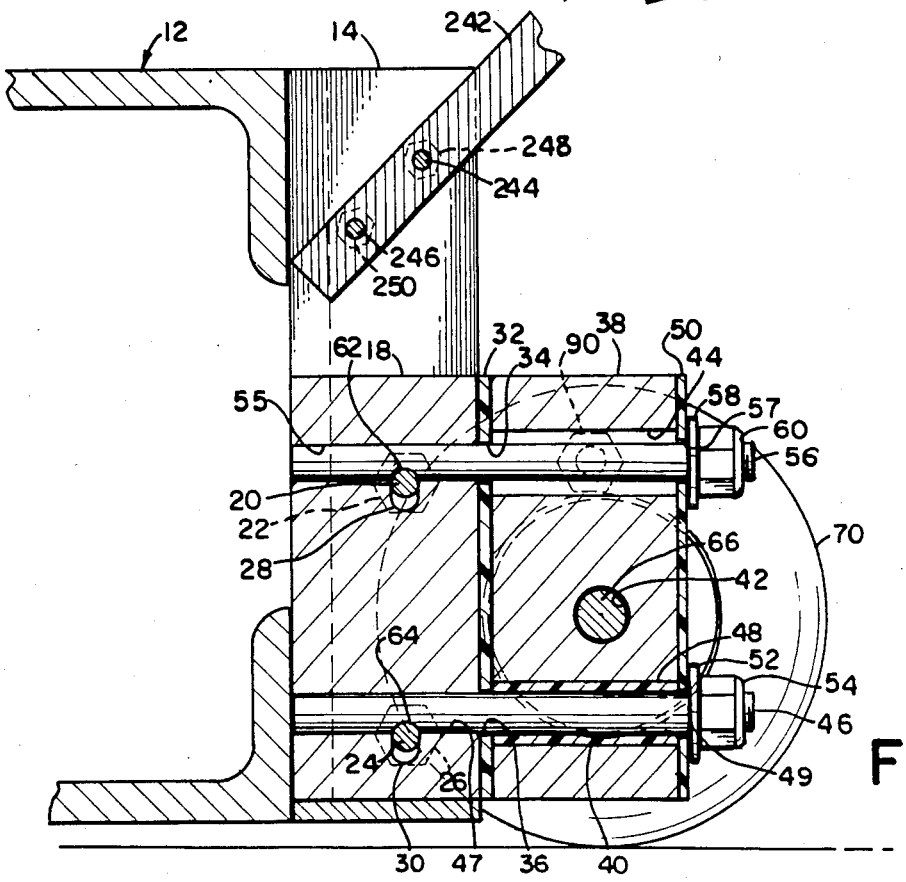
FIG. 6 is a sectional view taken along the line 6—6 of FIG. 5.

Referring to FIGS. 1 and 2, the power driven vacuum sweeper is designated by general reference numeral 10. The sweeper 10 includes a frame 12. The rear end of the frame as best shown in FIGS. 2, 5 and 6, has a pair of spaced apart angle bars 14, 16, extending therefrom. A first rectangular metal block 18 is positioned between the angle bars 14, 16. The block 18 is retained in a fixed position on the frame 12 by means of a pair of bolt and locknut connections 20, 22; 24, 26. FIG. 6 shows the bolts 20, 24 passing through the vertical slots 28, 30 in the block 18 and through bolt holes, not shown, in the angle bars 14, 16.

A rectangular bearing plate 32 is shown in FIG. 6 mounted on the right or rear surface of block 18. The wall of the first bearing plate 32 has two cylindrical passageways 34, 36 formed therein. A second rectangular metal block 38 which has substantially the same overall dimensions as the block 18 is shown in surface to surface engagement with the right or rear surface of the bearing plate 32. The block 38 has three passageways 40, 42, 44 passing therethrough.

As best shown in FIG. 6, a first pin 46 extends through and in press fit engagement with a wall forming a cylindrical passageway 47 in the first block 18. This pin 46 is also shown passing through a tube-shaped bearing 48 that is mounted in the wall forming passageway 40. The outer end of the first pin 46 is shown passing through a passageway 49 in a second bearing plate 50. Block 38 is mounted on pin 46 in slidable surface to surface contact with the left vertical surface of bearing plate 50. The outer end portion of the pin 46 is threaded and has a washer 52 and a locknut 54 thereon. A second pin 56 extends through and in press fit engagement with a wall forming a cylindrical passageway 55 in the first block 18. Pin 56 also passes through the cylindrical passageway 34 of the bearing plate 32 through and in spaced apart relation with the cylindrical passageway 44 and through cylindrical passageway 57 in bearing plate 50. The outer end portion of the second pin 56 is threaded and has a washer 58 and locknut 60 mounted thereon.

Each of the pins 46, 56 has an associated semi-spherical groove 64, 62 cut through its lower longitudinal surface to allow a smooth portion of its associated bolt 24, 22 to act as a key and thereby retain each of the pins from moving to the right of its positions as shown in FIG. 6. The bearing block 38 in FIGS. 5 and 6 is shown supporting a shaft 66 on which there is mounted a pair of wheels 68, 70. Each wheel is rotatably mounted on the shaft 66 by means of a pair of roller bearings 72, 74; 76, 78. Each of the opposite ends of the shaft 66 is provided with a roller retaining collar 80, 82 and associated set screws 84, 86 for retaining these collars in a fixed position on the shaft 66.

FIG. 5 shows the left side of the block 38 having a bolt 88 mounted in a wall forming a threaded passageway 89. The right side has a bolt 90 mounted in a wall forming a threaded passageway 91. Each bolt 88, 90 is shown passing in threaded engagement through the block 38 and into the space between the wall forming passageway 44 and the pin 56 passing therethrough. A locknut 92 is threadedly mounted on bolt 88 and a locknut 94 that is threadedly mounted on bolt 90 are used to fix the distance that the ends of these respective bolts protrude into the passageway 44. This is done by tightening the locknuts so they are in tight engagement with their respective sides of the block 38.

Six sleeves 96, 98, 100, 102, 104, 106 are shown surrounding the shaft 66 and acting as spacers between the block 38 and the wheels 68, 70. Although not shown, these sleeves are retained in a fixed position on the shaft by set screws.

FIG. 5 shows in dot-dash line form the tilted position that the right wheel 70 will take when it comes in contact with a portion of the floor shown in dash-line that slopes in an upward direction. It can also be seen that as this action occurs the block 38 will be rotated in a counterclockwise direction to its dot-dash line position. The maximum position to which it can be moved will be governed by the wall forming the passageway 44. The minimum position to which the block can be moved will be governed by the amount the inner end of bolts 88, 90 protrude into the passageway 44. As this tilting counterclockwise movement of the block 38 takes place, it will be rotated about the pivot shaft 46 while it slides along in surface to surface contact with each of the bearing plates 32, 50. The angle through which the vertical center line portion of the block 38 will travel when the right roller is tilted clockwise is indicated in FIG. 5 by the center line which extends upward and to the left of the vertical center line extending from the center of pin shaft 46. In a similar manner, it can readily be seen, although not shown, that, if the left wheel were tilted by a raised floor position in a clockwise direction, then, the block 38 will be rotated in an opposite or clockwise direction from its solid-line position shown in FIG. 5. The angle through which the center of the block 38 will travel during its clockwise movement is indicated by the remaining center line which extends upward and to the right of the vertical center line extending from the center of the pivot pin 46. It can be seen that the block on which the shaft is mounted therefore prevents clockwise or counterclockwise rocking movement of the wheels from being transmitted through the frame 12 to disturb the desired horizontal thorough sweeping position of the broom 108 shown in FIGS. 4 and 7.

Figure 7:
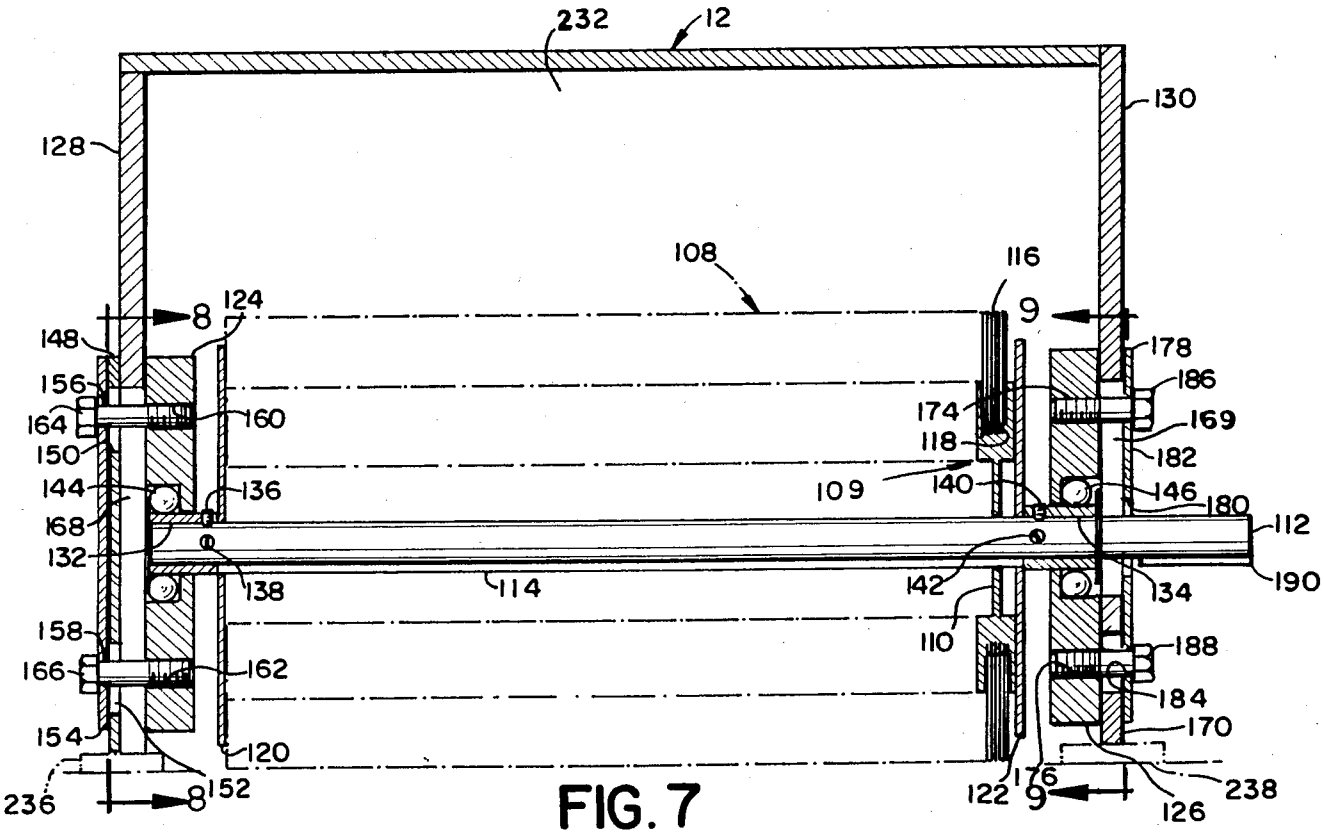
FIG. 7 is a sectional view taken along the line 7—7 of FIG. 4.

Although only one assembled brush unit 109 is shown in FIG. 7 for the broom 108, it is, in fact, made up of a series of brush units 109. Each unit is comprised of a supporting circular plate 110 slidably mounted by means of a key slot, not shown, on a shaft 112 that contains a key 114 extending along the entire length of the broom 108. A number of compressed steel bristles 116 extend outward in a peripheral direction from a U-shaped groove 118 in each circular plate 110. Retaining discs 120 and 122, each having a key slot, are shown slidably mounted on the key 114 and positioned to form end plates for the broom 108. The shaft 112 is supported at its ends for rotary movement by means of inner shaft bearing support plates 124, 126 positioned respectively on the inner surface of the right and left side plates 128, 130 of the frame 12 as viewed in FIG. 7. Each of the shaft support plates 124, 126 has an inner hub portion 132, 134 that is fixedly connected for rotation with the shaft 112 by means of set screws 136, 138; 140, 142. The hub portions 132, 134 are in turn shown schematically mounted for rotation on their respective shaft support plates 124, 126 by means of their associated ball bearings 144, 146.

Figure 8:
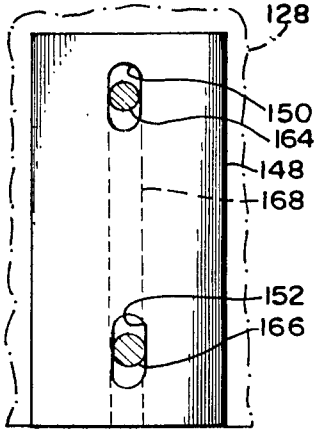
FIG. 8 is a sectional view taken along the line 8—8 of FIG. 7.

An outer broom support plate 148 is shown in FIGS. 7 and 8 in surface to surface contact with the left side wall 128 of frame 12. This plate 148 contains two vertical slotted wall portions 150, 152.

An additional plate 154, identical in overall size to plate 148, is shown in surface to surface contact with plate 148. This plate 154 contains two circular passageways 156, 158. The inner support plate 124 contains two threaded passageways 160, 162. A pair of bolts 164, 166 are shown extending through their respective passageways 156, 158 in plate 154, the slot openings 150, 152 in plate 148, the vertical slot 168 in the side plate 128 and shown threadedly connected with the passageways 160 and 162 formed in the left inner broom support plate 124. By tightening the bolts 164, 166, it can be seen that the outer plates 148, 154 and the inner plate 124 will be drawn into tight broom-supporting contact with the side plate 128 of the frame 12.

Figure 9:
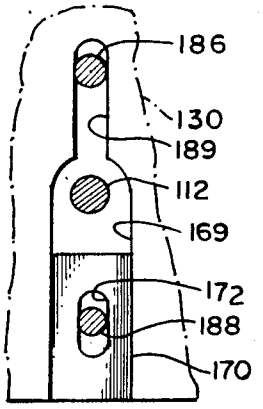
FIG. 9 is a sectional view taken along the line 9—9 of FIG. 7.

For ease in removing the shaft, the lower right side plate 130 is provided with a wider slot 169 than the slot 168 in the left side plate 128 as shown in FIGS. 7 and 9. The lower slotted part 169 is filled with a small rectangular plate 170 that has a vertically slotted wall portion 172 therein. Another purpose of the plate 170 is to close the air inlet in the skirt formed by the side and back plates 128, 130; 208, 232 of frame 12 when the broom 108 is in an operable position. The inner support plate 126 is also shown containing two threaded passageway 174, 176.

The rectangular plate 178 of FIG. 7 is approximately the same size as plate 148 in FIG. 8. Plate 178 also has a large circular passageway 180 at a central position thereof and two spaced apart passageways 182, 184 located on its vertical center line.

A pair of bolts 186, 188 are shown extending through their respective openings 182, 184 in plate 178, the upper narrow portion 189 of the slot 169 and the slot 172 in the skirt plate 170. These bolts 186, 188 are also shown threadedly connected with the threaded passageways 174, 176 formed in the right inner broom support plate 126.

By tightening the bolts 186, 188, it can be seen that the outer plate 178, skirt plate 170 and inner plate 126 will be drawn into tight broom supporting contact with the left side plate 130 of the frame 12.

Figure 3:
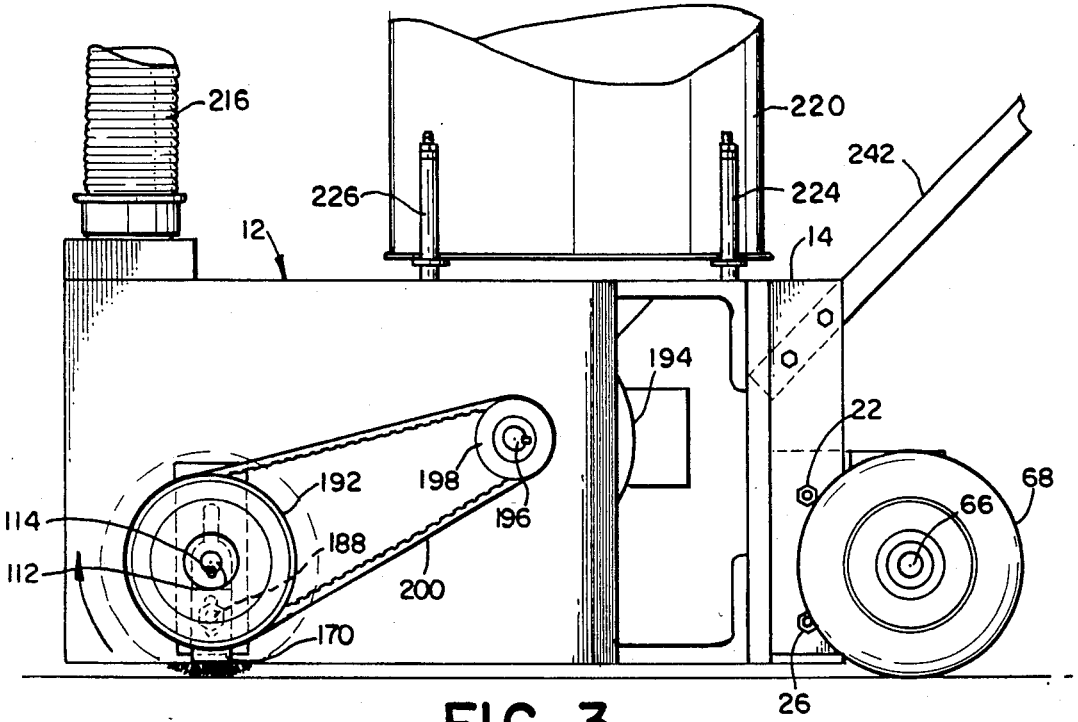
FIG. 3 is a view taken along the line 3—3 of FIG. 2.

FIG. 7 shows the outer right end portion of the shaft 112 as having a keyway 190 to retain a first pulley 192, FIGS. 1 and 3, in fixed driving relationship with the shaft 112. Preferably a high speed electric motor 194, its motor shaft 196, a second pulley 198 fixedly mounted on the shaft 196 and a drive belt 200, having inner drive teeth 202, is provided to transmit rotary motion to pulley 192 and its associated broom drive shaft 112. The electric motor 194 is operable to rotate at a predetermined speed and is schematically shown in FIG. 4 fixedly connected to a stationery support member 204.

Figure 4:
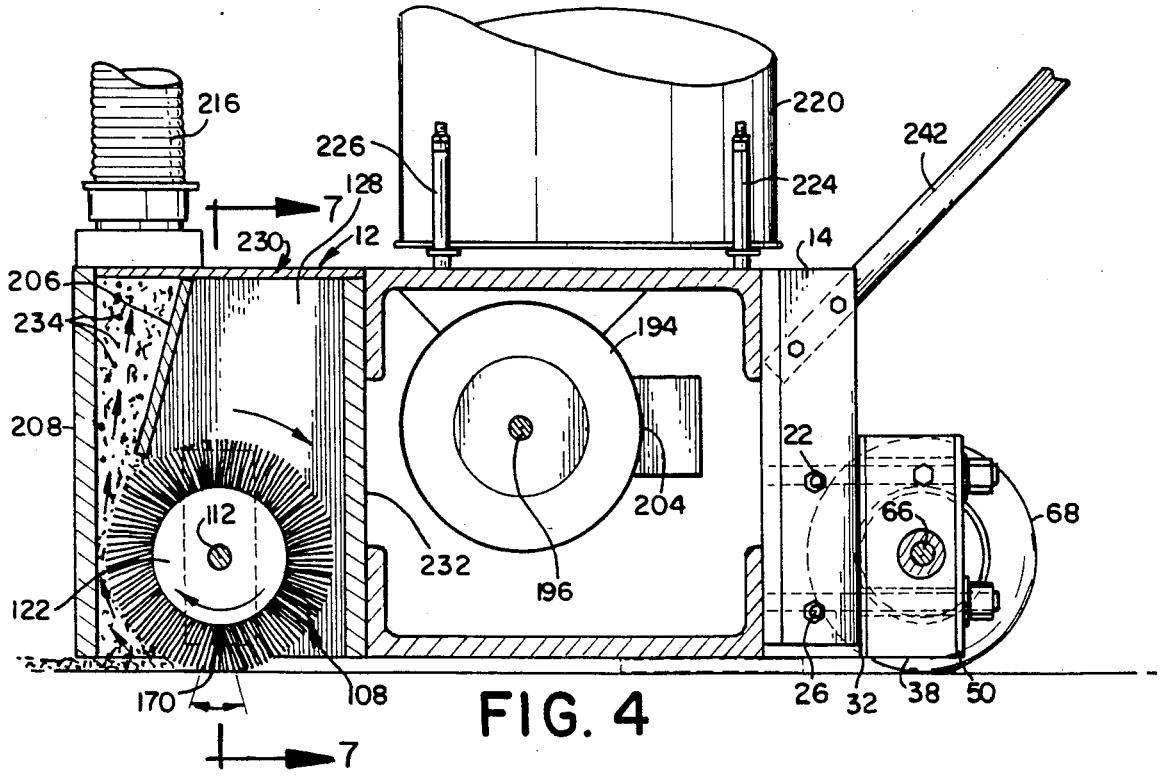
FIG. 4 is a sectional view taken along the line 4—4 of FIG. 2.

The sweeper 10 is further provided with the baffle plate 206 as best seen in FIGS. 1 and 4. This plate extends between the front end portions of the side plates 128, 130 of frame 12 and is connected to the inner wall surface of these plates. This baffle plate 206, the inner wall of the front end plate 208 of the frame 12 and the bristles of the broom 108 adjacent plate 208 forms a venturi.

FIG. 1 shows a circular passageway 210 formed in the top plate 212 of the frame 12. One end 214 of a flexible tube 216 extends through passageway 210 and is schematically shown connected in airtight relationship with the wall forming the passageway 210 in the top of plate 212. The other end 218 of the tube 216 is connected in airtight relationship to a vacuum tank 220. The tank 220 is supported on the top surface of plate 212 of the frame 12 and prevented from moving out of the position shown in FIG. 1 by means of pins 222, 224, 226, 228. These pins are connected in a fixed position on the top plate 212 and in a snug fashion with the external surface of the tank 220.

The tank 220 provides a vacuum to suck external air under the bottom surface of the side plates 128, 130 and front plate 232 and rear plate 232 into the skirt shaped chamber 230.

As the air is sucked in this manner into chamber 230 and through the space between the lowermost wall surfaces of the frame 12 and the floor, it will carry along with it the powdered particles of glue and padding 234 which are continuously being forced into this vacuum stream of air by the rotation of the brush 108. These particles 234 are then carried by the aforementioned sucking action through tube 216 into a storage chamber in tank 220. The construction of the sweeper 10 will thus make sure that the maximum sucking action of the powdered particles by the tank 220 is acquired and that the brush is properly positioned to provide a fast, clean sweeping action of the aforementioned padding and glue particles 234.

To prepare the sweeper for operation a pair of identical fixed sized blocks 236, 238 as shown in dot-dash line form in FIG. 7 are placed under the walls 128, 130 of the frame 12 of the sweeper 10. The height of each block that is satisfactory for most sweeping jobs is one quarter of an inch; e.g., as shown in FIG. 7. The broom is then allowed to position itself by gravity on the floor when bolts 164, 166, 186, 188 are loosened. The bolts are then tightened while the frame 12 is supported on the blocks 236, 238.

In some sweeping jobs a much thicker or much thinner layer of padding and glued particles must be removed from a floor. When the layer is thick, then the height that is used for the blocks 236, 238 will be greater than one quarter of an inch. If, on the other hand, the layer is extremely thin, then the height of the blocks 236, 238 will be set to less than one quarter inch. This sweeper construction can thus be adjusted to accomplish a wide range of sweeping jobs. These adjustments allow the proper amount of air to be sucked into the sweeper so that an optimal, efficient sucking of padding and glued particles can be effected for all of the aforementioned sweeping jobs.

A lever 240 is shown in FIGS. 4 and 5 having a first part 242 fixedly connected by means of a pair of bolts 244, 246 and locknuts 248 and 250 to the angle bars 14, 16. A second extendable part 252 of the lever 240 overlaps the first lever part. FIGS. 1 and 2 show the second lever part 252 which contains an elongated passageway 254 along a central longitudinal portion thereof. A third part of the lever 240 is in the form of a small plate 256 which is shown positioned below the second lever part 252.

A pair of bolts 258, 260 passes through the first lever part 242, the passageway 254 in the second part 252 and the small plate 256. Adjustment of the length of the lever 240 can be accomplished by sliding the second lever part 252 outwardly or inwardly of the lever position shown in FIG. 1 and by tightening the locknuts 262, 264 against the underside of the small plate 256.

A pair of handlebars 266, 268 that are fixed to the end of the slotted lever 252, such as by welding, is shown in schematic form in FIG. 1. A conventional safety switch 270 is shown in schematic form on the handlebar 268. The switch 270 has an electrical wire connection 272 that connects it to the junction box 274. The switch 270 acts to cut off the power to the motor 194 when the right hand grip shown in phantom line form is released from the handle 268. The box 274 is fixedly connected by welding or bolting, not shown, to the lever part 252.

Suitable electrical plug in power wire connection 276, 278 also extend between the vacuum tank 220 and the box 274 and between the electric motor 194 and the box 274. The box is equipped with off-on switches 280, 282 and an electrical wire power plug connection 284 for inserting in a local electrical power supply source, not shown.

The aforementioned lever 240 allows the operator to provide the maximum mechanical advantage for any given height of person operating the sweeper so that a minimal amount of pressure needs to be applied by the operator to the handles to cause the broom 108 to be pivoted about the fulcrum provided by the axle of the wheels 68, 70. This sensitive seesaw construction also allows the operator of this sweeper to be able to sense with his handlebar grip that he is obtaining an optimal shear of the padding and glue with the rotating broom.

What is claimed is:

1. A floor sweeping apparatus comprising:

a unitary frame;

a lever, said lever being fixedly connected at one end to a first rear portion of said frame;

handlebars fixedly connected to the other end of said lever;

a cylindrical bristle broom rotatably mounted on a front end of said frame, the bristles of said broom supporting said frame in a spaced apart relationship with a floor;

power means mounted on said frame and connected to said broom to rotate it in a first rotatable direction;

wheels mounted on another rear portion of said unitary frame for rolling said frame along the floor, manual straight line movement of said unitary handlebars, lever and frame in a right to left direction being operable to rotate said wheels in a second opposite rotatable direction along the floor and thereby counteract the tendency of said floor engaging rotating broom to move said frame, lever and handlebars in an opposing direction and said wheels being juxtapositioned to said broom and said lever to provide a fulcrum at the rear portion of said frame about which an upward movement of said handlebars increases the pressure applied by said bristles against the floor and a downward movement of said handlebars decreases the pressure applied by said bristles against the floor a pin, said pin having one end fixed to said frame, a block, said pin having its other end extending through a passageway in said block to form a pivot about which said block is pivotally mounted on said frame, a second passageway in said block, a shaft extending through said second passageway, a different one on said wheels rotatably supported on opposite ends of said shaft, said pin and block connection providing a means to allow said wheels to be oscillated in a seesaw manner when they encounter an irregular floor surface and without transmitting said oscillating motion by way of said frame to said broom.

2. A floor sweeping apparatus comprising;

a frame;

a lever, said lever being connected at one end to a first rear protion of said frame;

handlebars connected to the other end of said lever;

a cylindrical bristle broom rotatably mounted on a front end of said frame, the bristles of said broom supporting said frame in a spaced apart relationship with a floor;

power means mounted on said frame and connected to said broom to rotate it in a clockwise direction;

wheels mounted on another rear portion of said frame for rolling along the floor, said wheels being juxtapositioned to said broom and said lever to provide a fulcrum about which an upward counterclockwise movement of said handlebars increases the pressure applied by the bristles against the floor and a downward clockwise movement of said handlebars decreases the pressure applied by said bristles against the floor, said mounting for said wheels on said frame is comprised of a block and a first and second pin, each pin being fixed to said frame at one end and extending through said block at the other end, a bearing plate on the inner and outer side surfaces of said block, said first pin being positioned to provide a pivot about which the block can be rocked;

a shaft extending through the block and supporting a different one of said wheels at each one of its opposite ends;

a cylindrical passageway in said block, said second pin being positioned to pass through said passageway, a ring-shaped passageway formed by the outer surface of said second pin and the wall forming said cylindrical passageway, an irregularly high or low surface of the floor being effective to rock said wheels and said block about said first pin and the wall forming the cylindrical passageway in said block toward said second pin without transmitting said rocking motion to said frame and the broom mounted thereon.

3. A floor sweeping apparatus comprising:

a frame;

a lever, said lever being connected at one end to a first rear portion of said frame;

handlebars connected to the other end of said lever;

a cylindrical bristle broom rotatably mounted on a front end of said frame, the bristles of said broom supporting said frame in a spaced apart relationship with a floor;

power means mounted on said frame and connected to said broom to rotate it in a clockwise direction;

wheels mounted on another rear portion of said frame for rolling along the floor, said wheels being juxtapositioned to said broom and said lever to provide a fulcrum about which an upward counterclockwise movement of said handlebars increases the pressure applied by said bristles against the floor and a downward clockwise movement of said handlebars decreases the pressure applied by said bristles against the floor; the front end of the frame is comprised of two spaced apart side plates, a vertical passageway extending in an upward direction through the bottom surface of each side plate, a shaft passing through the central portion of said broom and supporting a series of bristle units thereon, a separate bearing support plate positioned on the inner surface of each said side plate, bearing means in each support plate to rotatably support spaced apart portions of said shaft, a retaining plate positioned on the outer surface of each of said side plates and a mechanically adjustable means extending through each passageway and between each of said retaining plates and their associated bearing support plates and the broom mounted thereon in a selected position on said side plates.

4. A floor sweeping apparatus comprising:

a frame;

a lever, said lever being connected at one end to a first rear portion of said frame;

handlebars connected to the other end of said lever;

a cylindrical bristle broom rotatably mounted on a front end of said frame, the bristles of said broom supporting said frame in a spaced apart relationship with a floor;

power means mounted on said frame and connected to said broom to rotate it in a clockwise direction;

wheels mounted on another rear portion of said frame for rolling along the floor, said wheels being justapositioned to said broom and said lever to provide a fulcrum about which an upward counterclockwise movement of said handlebars increases the pressure applied by said bristles against the floor and a downward clockwise movement of said handlebars decreases the pressure applied by said bristles against the floor, a vertical passageway is formed in opposite wall portions of the front end of said frame, a bristle support shaft extends through the center of said broom, a bearing support plate is positioned adjacent to each of said wall portions, means extending through each passageway to clamp each bearing support plate to its associated wall portion, one end of said support shaft being mounted for rotation in one of said bearing support plates and its other end being mounted for rotation in the other bearing support plate and the width of one of said passageways in one of said wall portions in said frame being wider than the diameter of said shaft to facilitate the removal of said shaft therethrough.

5. A floor sweeping apparatus comprising:

a frame;

a lever, said lever being connected at one end to a first rear portion of said frame;

handlebars connected to the other end of said lever;

a cylindrical bristle broom rotatably mounted on a front end of said frame, the bristles of said broom supporting said frame in a spaced appart relationship with a floor;

power means mounted on said frame and connected to said broom to rotate it in a clockwise direction;

wheels mounted on another rear portion of said frame for rolling along the floor, said wheels being juxtapositioned to said broom and said lever to provide a fulcrum about which an upward counterclockwise movement of said handlebars increases the pressure applied by said bristles against the floor and a downward clockwise movement of said handlebars decreases the pressure applied by said bristles against the floor, the wheel mounting formed by the rear end of said frame is comprised of a pair of spaced apart angle bars, a block positioned between and connected to said angle bars, a second block mounted for pivotal movement on said first block, a passageway in said second block, a shaft extending through said passageway, a different one of said wheels rotatably supported on opposite ends of said shaft, a stop means extending between said blocks to limit the pivotal movement of said second block with respect to the position of said first block and frame, and the said pivotal connection between said two blocks providing a means to allow said wheels to be oscillated in a seesaw manner when they encounter an irregular floor surface without transmitting said oscillating motion by way of said frame to said broom.

6. A power driven vacuum cleaning apparatus for removing pieces of carpet padding and dried glue from a floor comprising:

a frame;

a cylindrical wire bristle broom mounted on a front portion of the frame and supporting the frame in a spaced apart relationship with the floor, an electromechanical means supported on said frame to rotate said broom in a clockwise direction;

said frame having a top plate and a skirt plate extending downwardly therefrom forming a chamber about said broom, the lower surface of said skirt being located at said spaced apart distance from the floor, an electrically operated vacuum tank, a suction tube positioned between said tank and said chamber, said bristles of said broom being positioned to shear the pieces of carpet padding and dried glue from the floor and turn them into a dried powder while it is rotated in a clockwise direction;

said tank being operable to draw air through the bottom of said skirt into said chamber and simultaneously to suck up the sucked in air and said dried powder from said chamber, a pair of axially aligned wheels in contact with the floor and supported by a rear portion of the frame, a lever connected to said frame and extending in a rearward direction away from said wheels, said lever being operable to rock said frame about said wheels to thereby change the pressure that the bristles of the broom apply to the floor. said rear wheel support portion of said frame is comprised of a block pivotably mounted for rocking movement on said frame;

a shaft extending through said block and having a different one of said wheels mounted on its opposite ends, a stop pin fixed to said frame and extending therefrom, said stop pin being located in spaced apart relation to said block when the wheels are in engagement with a horizontal floor surface and said block being brought toward and into engagement with said stop pin to prevent further movement of said block as the wheels engage an uneven floor surface.

7. A floor sweeper comprising:

a cylindrical broom having bristles in contact with a floor;

a frame;

a pair of aligned wheels in contact with the floor;

a lever;

said broom being supported for rotation on a forward portion of said frame, a power drive means mounted on said frame and connected to said broom to rotate it in a clockwise direction, said frame being supported in an off-floor position by said bristles;

said frame being connected to support said wheels and an end of said lever on a rear portion thereof;

said wheels providing a fulcrum about which downward pressure to the free end of said lever will decrease the pressure applied by said bristles to the floor and an upward pressure to the free end of said lever will increase the pressure applied by said bristles, to the floor, the rear end of said frame has a block, said block being retained by means of a clamping means to the rear end of said frame;

a pivot pin, said pivot pin having one end portion in press fit engagement with said block;

a second block, a passageway extending through said block, a shaft connected in supporting engagement with said aligned wheels, said shaft being supported on said second block, the other end of said pin extending through said passageway and providing a pivot for said block, a means connected to an end of the pin to limit the outward longitudinal movement of said second block on said pin, said pin further providing a pivot about which said wheels and second block can be rocked when the axial position of said wheels is altered, a vertical passageway in said first block and said clamping means being vertically adjustable in said last mentioned passageway to alter the height of said frame with respect to said wheels.

* * * * *